US012766368B2

(12) United States Patent
Henningsen

(10) Patent No.: US 12,766,368 B2
(45) Date of Patent: Oct. 20, 2026

(54) GRIP FOR RACKET

(71) Applicant: Gripfixer Holding APS, Copenhagen K (DK)

(72) Inventor: Morten Dannerfjord Henningsen, Copenhagen S (DK)

(73) Assignee: Gripfixer Holding APS, Copenhagen K (DK)

( * ) Notice: Subject to any disclaimer, the term of this patent is extended or adjusted under 35 U.S.C. 154(b) by 346 days.

(21) Appl. No.: 18/019,188

(22) PCT Filed: Aug. 2, 2021

(86) PCT No.: PCT/EP2021/071559
§ 371 (c)(1),
(2) Date: Feb. 1, 2023

(87) PCT Pub. No.: WO2022/029074
PCT Pub. Date: Feb. 10, 2022

(65) Prior Publication Data

US 2023/0277901 A1 Sep. 7, 2023

(30) Foreign Application Priority Data

Aug. 6, 2020 (DK) ..... PA 2020 00897

(51) Int. Cl.
*A63B 49/08* (2015.01)
*A63B 49/035* (2015.01)
(Continued)

(52) U.S. Cl.
CPC ..... *A63B 49/08* (2013.01); *A63B 49/035* (2015.10); *A63B 60/10* (2015.10); *A63B 69/38* (2013.01);
(Continued)

(58) Field of Classification Search
CPC ..... A63B 49/08; A63B 49/035; A63B 60/10; A63B 69/38; A63B 2071/0655;
(Continued)

(56) References Cited

U.S. PATENT DOCUMENTS 2,046,191 A * 6/1936 Smith ..... A63B 60/00 473/203
4,000,893 A * 1/1977 Evans ..... A63B 69/38 473/437
4,072,311 A 2/1978 Bertucci
4,848,746 A * 7/1989 Klink ..... A63B 60/08 473/203
5,867,868 A * 2/1999 Ward ..... A63B 60/10 294/171

(Continued)

FOREIGN PATENT DOCUMENTS

DE 1020120963 A1 * 2/2022
JP 3176931 U 7/2012

OTHER PUBLICATIONS

International Search Report from International Application No. PCT/EP2021/071559, dated Nov. 3, 2021.
Danish Search Report from Danish Application No. PA 2020 00897, dated Feb. 16, 2021.

*Primary Examiner* — Nini F Legesse
(74) *Attorney, Agent, or Firm* — Morse, Barnes-Brown & Pendleton, P.C.; Sean D. Detweiler, Esq.

(57) ABSTRACT

A grip device for a racket includes at least two externally protruding bodies, a primary body and a secondary body, extending from the outer surface of the racket handle and being located circumferentially distanced from each other. The racket handle has a central longitudinal axis A, wherein the primary body is of a quadrilateral or triangular construction.

16 Claims, 5 Drawing Sheets

(51) Int. Cl.

| | |
|---|---|
| ***A63B 60/10*** | (2015.01) |
| ***A63B 69/38*** | (2006.01) |
| *A63B 71/06* | (2006.01) |
| *A63B 102/02* | (2015.01) |
| *A63B 102/06* | (2015.01) |
| *A63B 102/08* | (2015.01) |

(52) U.S. Cl.
CPC ..... *A63B 2071/0655* (2013.01); *A63B 2071/0694* (2013.01); *A63B 2102/02* (2015.10); *A63B 2102/06* (2015.10); *A63B 2102/08* (2015.10)

(58) Field of Classification Search
CPC ..... A63B 2071/0694; A63B 2102/02; A63B 2102/06; A63B 2102/08; A63B 2209/10; A63B 60/42; A63B 60/50; A63B 60/14; A63B 60/22; A63B 60/48; A63B 60/08
USPC ..... 473/203, 204, 226, 330–333, 457, 568, 473/549–553
See application file for complete search history.

(56) References Cited

U.S. PATENT DOCUMENTS

| | | | | |
|---|---|---|---|---|
| 6,916,260 | B1 * | 7/2005 | Poteet | A63B 60/00 473/551 |
| 7,125,353 | B2 * | 10/2006 | Blount | A63B 60/08 473/568 |
| 7,160,216 | B2 * | 1/2007 | Failla Colonnello Seppi | A63B 69/38 473/553 |
| 9,566,496 | B1 * | 2/2017 | Mallett | A63B 69/38 |
| 2005/0202910 | A1 | 9/2005 | Blount | |
| 2008/0032831 | A1 * | 2/2008 | Schroeder | A63B 69/38 473/464 |
| 2009/0011875 | A1 * | 1/2009 | Drake | A63B 60/00 473/551 |
| 2010/0113192 | A1 | 5/2010 | Aida | |
| 2014/0194230 | A1 * | 7/2014 | Lazarov | A63B 49/08 473/551 |
| 2018/0065010 | A1 | 3/2018 | Klontz | |

* cited by examiner

GRIP FOR RACKET

RELATED APPLICATIONS

This application is a national stage filing under 37 U.S.C. 371 of International Application No. PCT/EP2021/071559, filed Aug. 2, 2021, which claims priority to Denmark Patent Application No. PA 202000897, filed Aug. 6, 2020.

TECHNICAL FIELD OF THE INVENTION

The present invention relates to a grip device for a racket comprising at least two externally protruding bodies, a primary body and a secondary body, extending from an outer surface of a racket handle and being located circumferentially distanced from each other. In particular, the present invention relates to a grip device causing a well-defined grip around a racket in which a "well-defined grip" means that hand or hands and fingers occupy precise positions.

BACKGROUND OF THE INVENTION

The racket grips a player uses may have a significant influence on style of play. This is because the grip is one of the factors determining how stroke is performed i.e. how much spin is put and how much pace is generated.

If novices are not shown and instructed, they may use an inappropriate grip positioning, and even when they are shown the correct grip positioning, they tend to turn their grip positioning—consciously or unconsciously —, to an inappropriate grip positioning.

U.S. Pat. No. 4,072,311A discloses a device to be applied to the handle of a tennis racket. The device is generally of an obtuse triangular construction having rounded ends and sides and the device is tapered from its base (16A) towards its apex and is to be installed with its long side (16B) generally transversely of the major axis of the racket handle to separate the index finger from the remaining fingers. The device does not interfere with the grip during the serve. However, the angular position of the device determines which grip it guides, the device does not guide all grips when placed at a given position, the device only guides one grip.

U.S. Pat. No. 3,868,110A discloses a detachable grip for a tennis racket handle having finger and hand indentations accommodating different positions of the hand for forehand and backhand strokes. A tennis training aid may comprise the combination of a tennis racket and an elongated hollow grip therefor, having a central opening adapted to enclose the tennis racket handle, said opening being defined by a pair of wide sides and a pair of narrow sides; and means for detachably securing said grip to said handle, said grip being provided with indentations for positioning the four fingers and thumb of a user's hand in either a forehand stroke position or a backhand stroke position. As the device of this document comprises both finger and hand indentation, a user may experience problems with the size of the indentions, the device should therefore either be moulded to specifically fit the hand of the user, or the user must accept that the indentations does not fit perfectly, also it is not possible to adjust the grip to the size of the hand, and the grip does not guide semi-western grip.

GripFixx (https://gripfixx.com/) defines a product comprising an elastic band having a first and a second knob extending from the outer surface. The first and second knobs are identical in shape and size i.e. they are both round and are positioned relative to each other at an angle of 120 degrees angle when the product is mounted on the octagonal grip of a tennis racket. The GripFixx device does give some guidance when holding a tennis racket, but primarily due to the round shape of the protruding parts, it does not provide firm guidance in all situations.

As a correct grip positioning is very important, an improved device for helping the user to an appropriate grip positioning is desirable. An object of the present invention is therefore to provide a grip for a handle of a racquet such as a racquet for tennis, squash, paddle or the like, for assisting, teaching and helping novices in proving different grips when learning to play with such a racquet. The device according to the invention is particularly suitable for training different grips and how to change between the grips.

SUMMARY OF THE INVENTION

Thus, an object of the present invention relates to a device which improving teaching of grips for a racquet.

In particular, it is an object of the present invention to provide a device that solves the above-mentioned problems of the prior art by providing a simple device, build into or attached to a racquet handle.

Thus, one aspect of the invention relates to a grip device for a racket comprising at least 2 externally protruding bodies, a primary body and a secondary body, which during use extend from an outer surface of a racket handle and are located circumferentially distanced from each other, the racket handle has a central longitudinal axis A, wherein the primary body is of a quadrilateral or triangular construction.

According to an embodiment of the invention, the primary and secondary bodies are not identical, not in shape neither in size.

According to an embodiment of the invention, depending on whether the construction is quadrilateral or triangular, the primary body may comprise 6 or 5 surfaces, where

- a first surface faces the racket handle,
- a second surface faces away from the racket handle and is of same/similar shape as the first surface and may be of same or smaller area,
- a third and a fourth surfaces connect the first and the second surfaces, where the third surface is at least partly facing in direction towards the racket head and extends along a straight line or a slightly curved line in an angle alfa relative to the axis A, and where the fourth surface is at least partly facing in direction away from the racket head and extends along a straight line or a slightly curved line in an angle beta relative to the axis A. According to an embodiment of the invention, a fifth surface may connect the first and second surface and the third and fourth surface while the fifth surface is facing away from the racket head, the fifth surface may be curved and adapted to accommodate the gap between an index finger and a middle finger.

According to an embodiment of the invention, the secondary body may comprise a body of conic section construction, or a quadrilateral construction, or a triangular construction and the area of a first surface of the secondary body is smaller than the area of the first surface of the first body and preferably the secondary body) has a straight/flat surface facing in direction of the racket head.

According to an embodiment of the invention, the minimum distance between the primary body and the secondary body may correspond to a user's finger, i.e. the distance may be between 5 and 25 mm.

According to an embodiment of the invention, the device may comprise 3 externally protruding bodies extending from the outer surface of the racket handle and being located circumferentially distanced from each other.

According to an embodiment of the invention, the third body may be positioned at a circumferential distance to the primary body corresponding to a user's finger, i.e. the minimum distance between the first and the third body is between 5 and 25 mm. According to an embodiment of the invention, none of the 2 or 3 externally protruding bodies has a round cross-section, i.e. each of the protruding bodies may have a substantially flat surface extending from the surface of the racket handle.

According to an embodiment of the invention, primary and/or secondary externally protruding bodies may comprise releasable fastening means at a first surface facing the racket handle allowing attaching/detaching of one or all of the protruding bodies e.g. at different positions, optionally the racket handle or a surface such as a band attached to the racket handle (4) comprises corresponding fastening means.

Another aspect of the present invention relates to a band or wrap comprising a grip device according to the first aspect for a racket.

According to an embodiment of the second aspect, a device may comprise means for fastening of the band to the racket handle.

According to an embodiment of the second aspect, the device may comprise means defining the angular position of the grip device relative to the racket, which means may e.g. comprise a line or a point defined as either a depression or an elevation or another tactile or visual indication of angular position.

Figure 1:
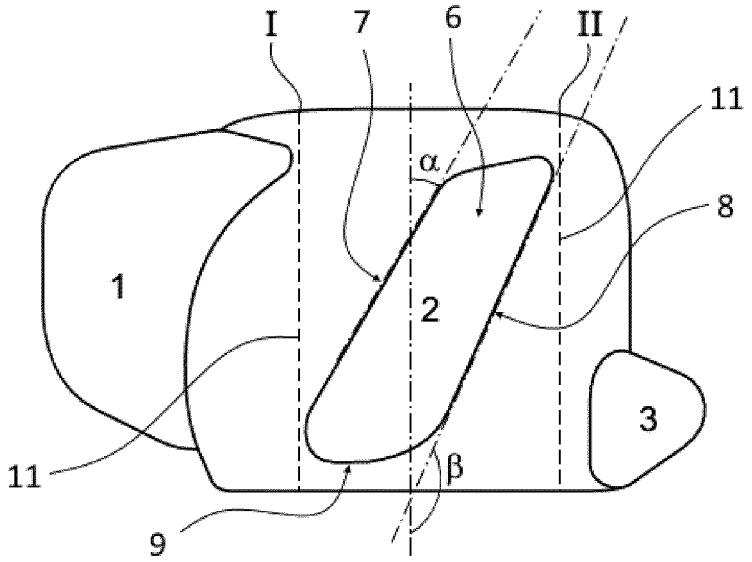
FIG. 1 shows a side view of a grip device according to the invention positioned on a racket handle.

The present invention will now be described in more detail in the following.

Definitions

Prior to discussing the present invention in further details, the following terms and conventions will first be defined:

In general—when these words are used in the specification it means that the feature described may be applied with all embodiments of the invention, even if the mentioning of the feature appears in connection with an otherwise specific embodiment of the invention.

DETAILED DESCRIPTION OF THE INVENTION

In general, the invention relates to a grip device for a racket handle 4, which grip device comprises at least 2 externally protruding bodies, a primary body 2 and a secondary body 3. The two bodies extend from the outer surface of the racket handle 4 and provide guiding means for a user's hand and fingers when practicing with the racket. The externally protruding bodies 2, 3 are located circumferentially distanced from each other within a relatively short length of the racket handle, normally within a band of between 2-5 cm. Also, for a right-handed player, the secondary body 3 is position in a clockwise direction relative to the primary body 2, i.e. the distance in the clockwise direction along the surface of a racket handle is shorter than the distance in a counterclockwise direction.

According to an embodiment for a left-handed player, the relative positions of the protruding bodies will be mirrored. Throughout this specification the embodiments are described for right-handed player, and it is to be understood that mirrored embodiments useful for a left-handed are included in the scope of this specification.

In the following, different angles are defined relative the longitudinal axis A of the racket handle 4, which is shown in FIG. 1. The longitudinal axis A extends from the top of the racket head or the stringed surface to the opposite lower end of the racket and is parallel to the surface of the handle in the longitudinal direction of the handle.

That the protruding bodies 2, 3 are located circumferentially distanced from each other means that there is a gap between the protruding bodies and that the protruding bodies 2, 3 are displaced relative to each other around the racket handle 4.

According to an embodiment, the grip device may comprise 3 externally protruding bodies 1, 2, 3 extending from the outer surface of the racket handle 4 and located circumferentially distanced from each other. If the grip device comprises 3 externally protruding bodies, the third protruding body 1 is positioned counterclockwise relative to the primary protruding body 2, i.e. the distance in the counterclockwise direction along the surface of a racket handle is shorter than the distance in a clockwise direction.

None of the 2 or 3 externally protruding bodies 1, 2, 3 has a completely round or circular cross-section as this will not provide adequate guiding of the fingers in a grip. Each protruding body may comprise at least one straight or flat surface providing guidance for either a hand or a finger. Each protruding body, in particular the primary and/or secondary protruding bodies, may comprise at least two substantially flat surfaces providing guidance for either a hand or a finger. The surfaces might be slightly concave.

FIG. 1 shows a first embodiment of the invention positioned on a racket handle. This first embodiment comprises three externally protruding bodies 1, 2 and 3 where the secondary body 3 is positioned clockwise relative to the primary protruding body 2 and the third body 1 is positioned counterclockwise relative to the primary protruding body 2. In FIG. 1 the primary protruding body 2 is shown as a central body.

According to the present invention, the primary protruding body 2 is of a quadrilateral or triangular construction, if the corners are rounded the quadrilateral or triangular construction may approach or become a substantially elliptic construction.

In general, the secondary protruding body 3 may comprise a body of conic section construction, or a quadrilateral construction, or a triangular construction. A first surface of a protruding body is defined as a surface being in contact with the racket handle, and the area of a first surface 5 of the secondary protruding body 3 is smaller than or equal to the area of the first surface 5 of the primary protruding body 2.

The secondary protruding body 3 may comprise a straight or flat surface facing the racket head and deviating approximately 30-75 degrees, or alternatively 30-45 degrees from the longitudinal axis A of the racket handle 4.

The minimum distance between the primary protruding body 2 and the secondary protruding body 3, and between a third protruding body 1 and the primary protruding body 2, corresponds to a user's finger, i.e. the minimum distance is between 5 and 25 mm.

The minimum distance between the primary protruding body 2 and the secondary protruding body 3 may be varied within these limits to adapt the grip device to a specific user.

Either, a user may acquire a grip device according to the invention fitting to the size of the user's hand, or the externally protruding bodies of the grip device may comprise releasable fastening means allowing the user to arrange the externally protruding bodies 1, 2, 3 in a pattern adapted to the user's hand and to a preferred grip on the racket handle.

According to such an adaptable embodiment, the primary and/or secondary and/or third externally protruding body 1, 2, 3 may comprise releasable fastening means at the first surface 5 facing the racket handle. That the releasable fastening means are at the first surface means that the fastening means are attached to or provided at or extends from the first surface 5.

Such releasable fastening means will allow attaching and detaching of each protruding body 1, 2, 3 comprising the fastening means either at different positions or to allow the user to use the racket both with and without the grip device. Optionally the racket handle 4 or a surface such as a band attached to the racket handle 4 may comprise corresponding fastening means which e.g. may indicate to the user where it is possible to attach the protruding bodies of the grip device.

The primary and secondary externally protruding bodies are not identical. This feature supports the ability of the user to shift freely between several grips defined by the device.

The primary protruding body 2 may comprise 6 or 5 surfaces depending on whether the construction is quadrilateral or triangular. As the "corners" or the boundary between two neighbouring surfaces will normally be rounded in order to increase the comfort and easy shifting from one grip to another, it might be difficult to determine an exact border line, however, the following specifically defined surfaces does exist at a part of the outer surface of the grip device.

The primary protruding body 2 has a first surface 5 facing the racket handle 4. This surface comprises the surface being directly in contact with the racket handle or being in contact with a unit such as a band or similar fastened to the racket handle 4 during use.

Further, the primary protruding body 2 may comprise a second surface 6 facing away from the racket handle 4, this second surface 6 is of same or of similar shape as the first surface but possibly of a smaller area as the corners between the second surface 6 and the neighbouring surfaces are rounded.

The primary protruding body 2 may also comprise a third and fourth surface 7, 8 connecting the first and the second surfaces 5, 6 along the sides. The third surface 7 is at least partly facing in direction towards the racket head and extends along a straight line or a slightly curved line in an angle alfa ($\alpha$) relative to the longitudinal axis A, and the fourth surface 8 is at least partly facing in direction away from the racket head towards the lower end of the racket and extends along a straight line or a slightly curved line in an angle beta ($\beta$) relative to the longitudinal axis A. Each of the two surfaces, third 7 and fourth 8, will during use of the grip device provide guidance for the index finger when a user practices with the racket.

The primary protruding body 2 may also comprise a fifth surface 9 connecting the first and second surface 5, 6 and the third and fourth surface 7, 8, which fifth surface 9 is facing away from the racket head. The fifth surface 9 is curved and adapted to accommodate the gap between an index finger and a middle finger in a comfortable way.

According to one embodiment, the grip device may be unreleasably mounted on a band or wrap. This makes it possible for the user to attach the grip device to a racket during grip-practising session and detach the grip device from the racket when match training.

Figure 2:
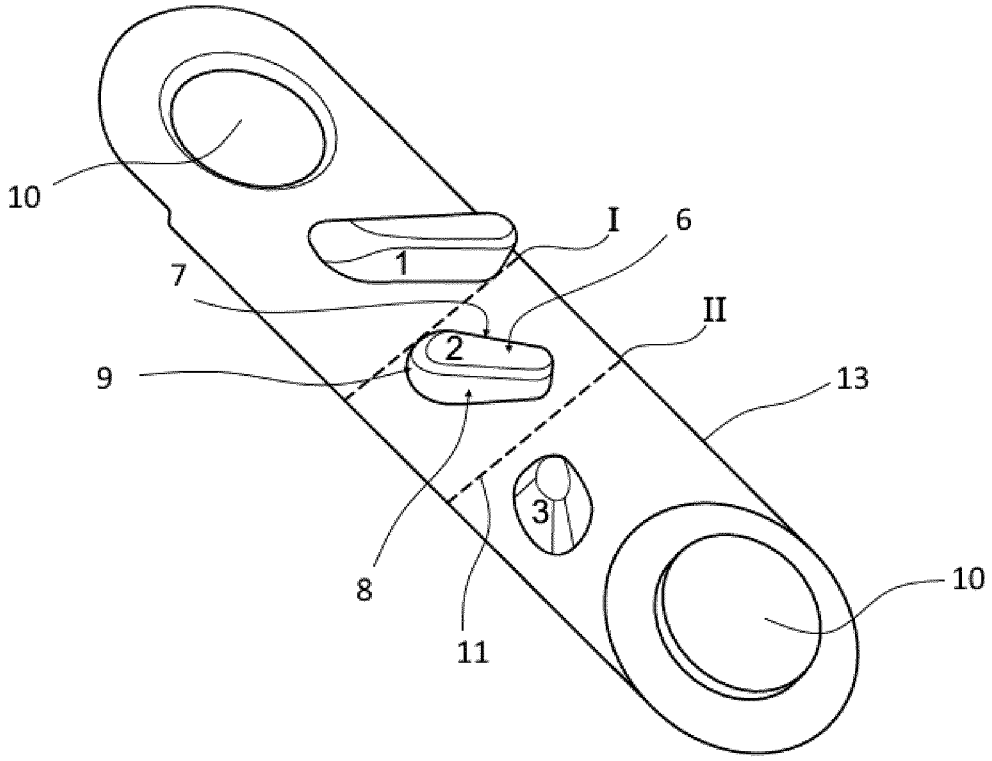
FIG. 2 shows a grip device according to the invention positioned on a band which band is not attached to a racket handle.

FIG. 2 shows an embodiment of the invention where the grip device is placed on a separate band 13.

Such a band 13 may comprise fastening means 10 used to attach the band 13 to a racket handle 4 at a desired position in the lengthwise direction. These fastening means 10 may e.g. be provided by the elasticity of the band 13 alone or the fastening means 10 may comprise or be constituted of corresponding locking means at each end of the band 13 as shown in the embodiment of FIG. 2 where a male part is clicked into a female part during attachment, or according to a preferred embodiment, the fastening means 10 may comprise a combination of the these two.

No matter whether the protruding bodies of the grip device is indirectly attached to the racket handle 4, e.g. via a band or whether the protruding bodies of the grip device is directly attached to the racket handle 4, the protruding bodies 1, 2, 3 are normally positioned at the same lengthwise level of the racket handle. In particular, the point of each protruding body being closest to the lower end of the racket are at the same lengthwise level or at least the points of each protruding body being closest to the lower end of the racket do not deviate more than 20 mm, e.g. more than 10 mm, from each other.

In general, a grip device according to the invention may e.g. be suitable for rackets for tennis, squash and paddle.

Figure 3:
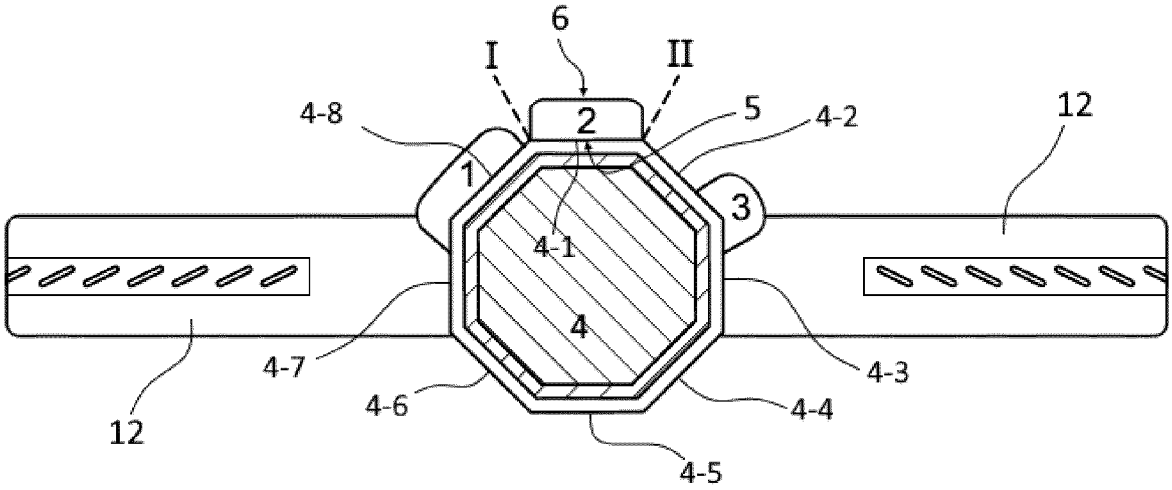
FIG. 3 shows a cut-through view of racket handle just below a grip device according to the invention positioned on the racket handle.

FIG. 3 illustrates the relative position of the protruding bodies seen from the lower end of the racket.

The racket handle is octagonal and has eight bevels. The eight bevels of the racket handle has been numbered 4-1, 4-2, . . . , 4-8.

When in use, the primary protruding body 2 is positioned at bevel 4-1, the secondary protruding body 3 is positioned around the border between the bevels 4-2 and side 4-3 and extends on both bevel 4-2 and 4-3, and the third protruding body 1 is positioned across the border between bevels 4-7 and 4-8 and extends over both bevel 4-7 and 4-8.

The racket head 12 extends in the direction of 4-3 and 4-7 respectively.

When the protruding bodies are attached to or being part of a band 13, a marking 11 such as one or two marking lines I and II extending in the longitudinal direction of the racket handle 4 may indicate to the user at which angular position the band 13 is to be placed during use.

The marking means 11 in form of the marking lines I, II shown in FIG. 3 is to be positioned respectively along the edge between bevel 4-8 and 4-1 and along the edge between bevel 4-1 and 4-2. Marking means 11 in the form of markings lines or punctures indicating same or other edges may also be used according to the invention. The marking lines I and II may be provided by indentations or protrusions making it possible for the user to feel where the markings are to be positioned.

Figure 4A:
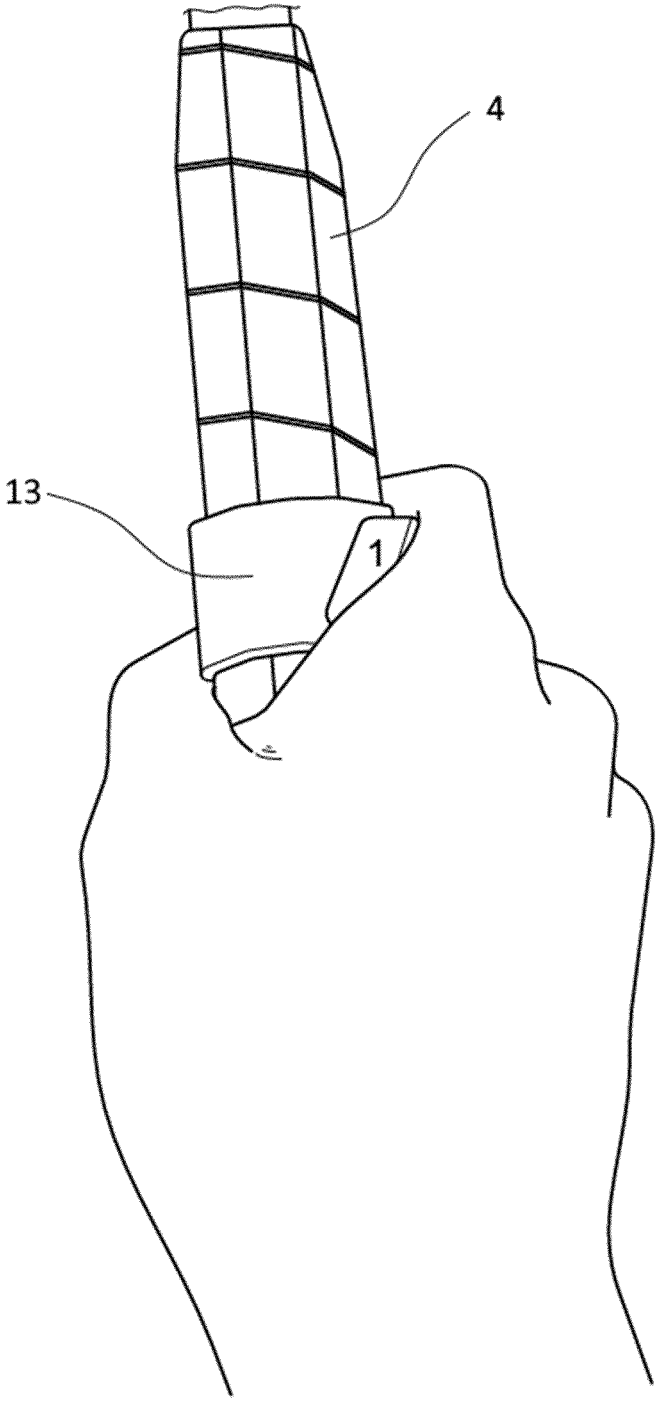
FIG. 4A-4C illustrates hand-positions being supported when holding a racket with a grip device according to the invention.

FIG. 4A illustrates a hand position generally known as "continental" and how the grip device guides the user's fingers and hand in this particular grip. When using this grip, the knuckle of the index finger is guided by the device as the knuckle of the index finger is positioned between the tertiary 1 and the primary 2 protruding body, while the heel pad is positioned on bevel 4-8.

When using a grip device according to the invention, the index finger in this grip is positioned between the third surface 7 of the primary protruding body 2 and the third protruding body 1 and each of these two protruding bodies are in contact with the index finger guiding the position of the index finger with a relatively flat surface which two relatively flat guiding surfaces facing each other.

Figure 4B:
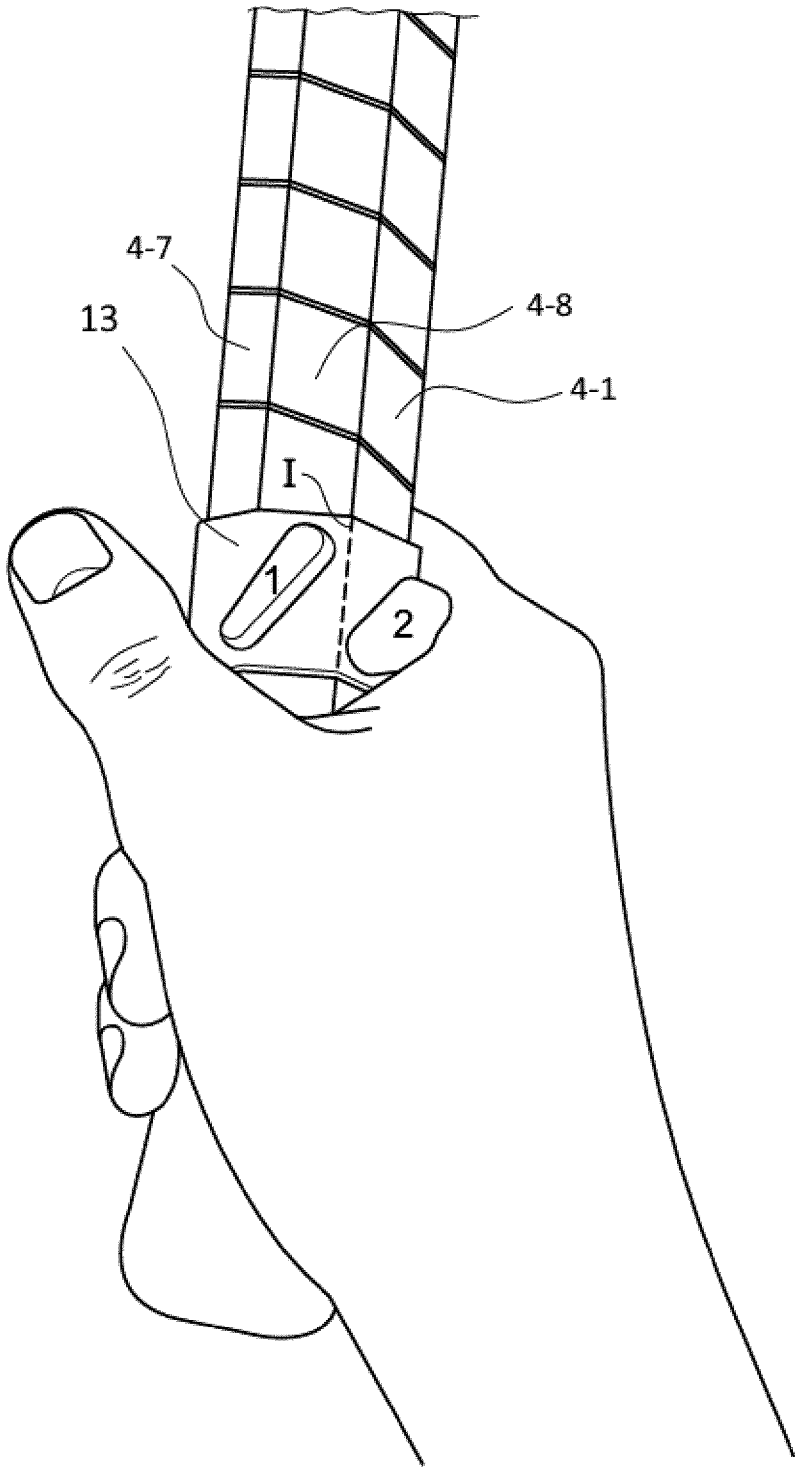

FIG. 4B illustrates a hand position generally known as "semi western forhand" and how the grip device guides the user's finger/hand in this particular grip. When using this grip, the knuckle of the index finger is normally positioned on bevel 4-2 and the heel pad is positioned around bevel 4-1.

When using a grip device according to the invention for "semi western forhand", the index finger is positioned between the fourth surface 8 of the primary protruding body 2 and the secondary protruding body 3 when holding the racket.

Figure 4C:
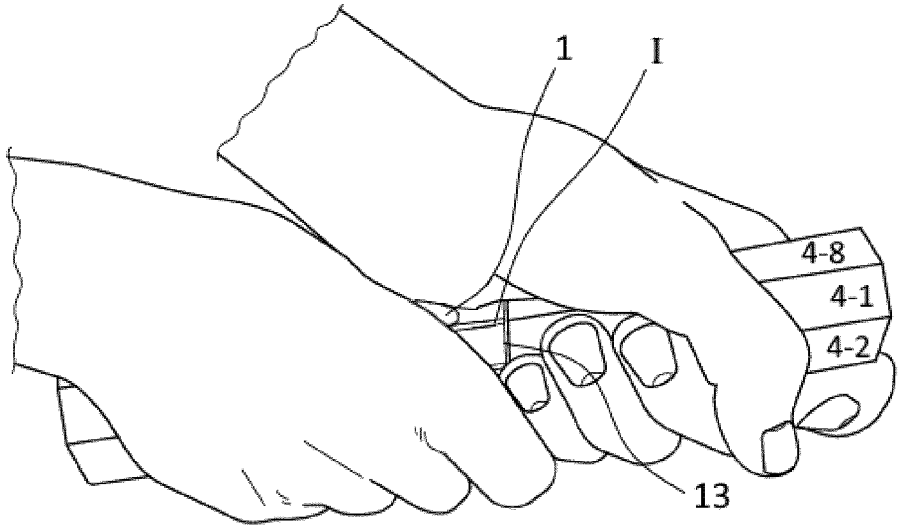

FIG. 4C illustrates a hand position generally known as "two handed backhand", and how the grip device guides the user's hands in this particular grip.

When using this grip, the protruding body 3 may guide the lower part of the left hand whereas the right hand may hold a continental grip as described above, where the knuckle of the index finger is guided by the gap between the third protruding body 1 and the first protruding body 2.

It should be noted that embodiments and features described in context of one of the aspects of the present invention also apply to other aspects of the invention.

| Ref. no. | Name |
|---|---|
| 1 | Third or tertiary protruding body |
| 2 | First or primary protruding body |
| 3 | Second or secondary protruding body |
| 4 | Racket handle |
| 5 | First surface or contact surface |
| 6 | Second surface |
| 7 | Third surface |
| 8 | Fourth surface |
| 9 | Fifth surface |
| 10 | Fastening means for band |
| 11 | Means defining angular position of a band relative to racket (I, II) |
| 12 | Racket head |
| 13 | Band adapted to racket handle |
| A | Longitudinal axis of racket handle |

What is claimed is:

1. A grip device for a racket comprising at least two externally protruding bodies, a primary body and a secondary body, wherein the primary body is of either a quadrilateral or a triangular construction, extending from the outer surface of a racket handle which racket handle has a central longitudinal axis, and the at least two externally protruding bodies are;

circumferentially distanced from each other around the racket handle; and positioned within a longitudinal distance of no more than 5 cm from each other along the longitudinal axis;

so that the at least two protruding bodies can be simultaneously engaged by adjacent fingers of a user's hand.

2. The grip device according to claim 1, wherein depending on whether the construction is quadrilateral or triangular the primary body comprises five or six surfaces, where a first surface faces the racket handle, a second surface faces away from the racket handle and is of same/similar shape as the first surface and is of same or smaller area, a third and a fourth surfaces connect the first and the second surfaces, where the third surface is at least partly facing in direction towards the racket head and extends along a straight line or a slightly curved line in an angle alfa relative to the longitudinal axis, and where the fourth surface is at least partly facing in direction away from the racket head and extends along a straight line or a slightly curved line in an angle beta relative to the longitudinal axis.

3. The grip device according to claim 2, wherein a fifth surface connects the first and second surface and the third and fourth surface and is facing away from the racket head, the fifth surface is curved and adapted to accommodate the gap between an index finger and a middle finger.

4. The grip device according to claim 1, wherein the secondary body comprises a body of conic section construction, or a quadrilateral construction, or a triangular construction and an area of a first surface of the secondary body is smaller than an area of the first surface of the first body and preferably the secondary body has a straight/flat surface facing in direction of the racket head.

5. The grip device according to claim 1, wherein the minimum distance between the primary body and the secondary body is between 5 and 25 mm.

6. The grip device according to claim 1, comprising three externally protruding bodies, the primary body, the secondary body, and third body, extending from the outer surface of the racket handle and being located circumferentially distanced from each other.

7. The grip device according to claim 6, wherein the third body is positioned at a circumferential distance to the primary body, wherein the minimum distance between the first and the third body is between 5 and 25 mm.

8. The grip device according to claim 1, wherein the primary and/or secondary externally protruding bodies comprises releasable fastening means at a first surface facing the racket handle allowing attaching/detaching of the protruding body at different positions.

9. The grip device according to claim 8, wherein the racket handle or a band attached to the racket handle comprises corresponding fastening means.

10. The grip device according to claim 1, wherein the primary and secondary bodies are not identical, not in shape nor in size.

11. The grip device according to claim 1, wherein none of the externally protruding bodies have a round cross-section, wherein each of the protruding bodies may have a substantially flat surface extending from the surface of the racket handle.

12. The grip device according to claim 1, wherein the primary and/or secondary externally protruding bodies comprises releasable fastening means at the first surface facing the racket handle allowing attaching/detaching of one or all of the protruding bodies at different positions.

13. The grip device according to claim 12, wherein the racket handle or a band attached to the racket handle comprises corresponding fastening means.

14. A band comprising a grip device according to claim 1, which band comprises fastening means for fastening of the band to the racket handle.

15. The band according to claim 14, further comprising means defining the angular position of the grip device relative to the racket, which means may comprise a line or a point defined as either a depression or an elevation or another tactile or visual indication of angular position.

16. A band comprising:

at least two externally protruding bodies, a primary body of either a quadrilateral or a triangular construction and a secondary body, and fastening means for fastening the band to a racket handle having a central longitudinal axis; wherein when the band is fastened to the racket handle, the at least two externally protruding bodies are:

circumferentially distanced from each other around the racket handle; and positioned within a longitudinal distance of no more than 5 cm from each other along the longitudinal axis;

so that the at least two protruding bodies can be simultaneously engaged by adjacent fingers of a user's hand.

* * * * *